US011539137B2

(12) United States Patent
Flores-Cuadras

(10) Patent No.: US 11,539,137 B2
(45) Date of Patent: Dec. 27, 2022

(54) SOCKET ANTENNA MODULE AND RELATED TRANSCEIVER ASSEMBLY

(71) Applicant: 2J ANTENNAS USA, CORPORATION, Gilbert, AZ (US)

(72) Inventor: Javier Ruben Flores-Cuadras, Chandler, AZ (US)

(73) Assignee: 2J ANTENNAS USA, CORPORATION, Gilbert, AZ (US)

( * ) Notice: Subject to any disclaimer, the term of this patent is extended or adjusted under 35 U.S.C. 154(b) by 226 days.

(21) Appl. No.: 17/004,370

(22) Filed: Aug. 27, 2020

(65) Prior Publication Data

US 2021/0066805 A1 Mar. 4, 2021

Related U.S. Application Data

(60) Provisional application No. 62/892,143, filed on Aug. 27, 2019.

(51) Int. Cl.

| | |
|---|---|
| ***H01Q 1/52*** | (2006.01) |
| ***H01Q 9/04*** | (2006.01) |
| ***H01Q 1/38*** | (2006.01) |

(52) U.S. Cl.

CPC ..... *H01Q 9/0414* (2013.01); *H01Q 1/38* (2013.01); *H01Q 1/526* (2013.01)

(58) Field of Classification Search

CPC ..... H01Q 9/0414; H01Q 1/38; H01Q 1/526; H01Q 1/1207; H01Q 9/0407

See application file for complete search history.

(56) References Cited

U.S. PATENT DOCUMENTS

| | | | | |
|---|---|---|---|---|
| 2003/0030588 | A1* | 2/2003 | Kalis | H01Q 21/29 343/700 MS |
| 2005/0020214 | A1* | 1/2005 | Neill | H01Q 9/0407 455/73 |
| 2008/0180332 | A1* | 7/2008 | Noro | H01Q 9/0407 343/713 |
| 2010/0073236 | A1* | 3/2010 | Mierke | H01Q 9/0414 343/700 MS |
| 2019/0379124 | A1* | 12/2019 | Zou | H01Q 9/065 |
| 2020/0243945 | A1* | 7/2020 | Iwaki | H01Q 1/52 |
| 2020/0313298 | A1* | 10/2020 | Hwang | H01Q 9/0407 |
| 2022/0158332 | A1* | 5/2022 | Chen | H01Q 1/38 |

* cited by examiner

*Primary Examiner* — David E Lotter

(74) *Attorney, Agent, or Firm* — CP Law Group PC; Cy Bates

(57) ABSTRACT

A socket antenna module includes a patch antenna, a ground plane, and a shield can, the ground plane having a first side and second side, and the patch antenna being coupled to the first side, whereas the shield can is coupled to the second side opposite the first side. In another embodiment, a socket antenna module and transceiver assembly is disclosed that integrates the socket antenna module with a conventional transceiver.

20 Claims, 5 Drawing Sheets

SOCKET ANTENNA MODULE AND RELATED TRANSCEIVER ASSEMBLY

CROSS-REFERENCE TO RELATED APPLICATIONS

This application claims benefit of priority with U.S. Provisional Application Ser. No. 62/892,143, filed Aug. 27, 2019; the entire contents of which are hereby incorporated by reference.

BACKGROUND

Field of the Invention

This invention relates to antennas; and more particularly, to a socket antenna module and related transceiver assembly for mitigating limitations of spatial resources and improving against detuning effects.

Description of the Related Art

In many modern communication devices and applications, size requirements for antenna placement are extremely limited. While Iridium transceivers are commercially available, and sometimes used with patch antennas, the patch antenna is generally placed adjacent to the transceiver consuming valuable spatial resources and often coupling with nearby componentry causing excessive detuning effects. It would be an improvement in the art to solve problems associated with limited space and detuning effects in combinations including antennas and corresponding transceivers.

SUMMARY

A socket antenna module is disclosed, the socket antenna module comprising a patch antenna, a ground plane, and a shield can each configured to be arranged in a novel relationship with respect to one another. The ground plane includes a first side and second side; the patch antenna is coupled to the first side and the shield can is coupled to the second side opposite the first side.

Other advantages and benefits are further described in the appended detailed description.

BRIEF DESCRIPTION OF THE DRAWINGS

Other features, combinations, and embodiments will be appreciated by one having the ordinary level of skill in the art of antennas and accessories upon a thorough review of the following details and descriptions, particularly when reviewed in conjunction with the drawings, wherein.

DETAILED DESCRIPTION

Figure 1:
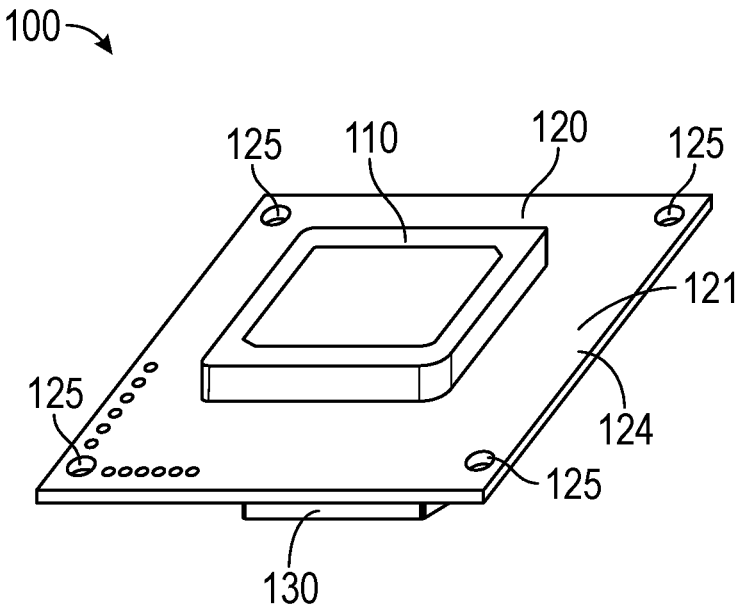
FIG. 1 shows an isometric view of the socket antenna module in accordance with the first embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

General Description of Embodiments

In a first embodiment, a socket antenna module is disclosed, the socket antenna module comprises a ground plane configured to extend within a horizontal plane and having a first side, a second side opposite the first side, and a perimeter associated therewith. The ground plane further comprises a plurality of holes, each of said holes being disposed along the perimeter of the ground plane at or near one of a plurality of corners thereof. A patch antenna is coupled to the ground plane at the first side, the patch antenna including a dielectric substrate, and a polygonal metal patch coupled to the dielectric substrate. A feed connector is coupled to the polygonal metal patch at a first end thereof and further configured to couple with a feed at a second end thereof on an opposite side of the dielectric substrate. A shield can is coupled to the ground plane at the second side, the shield can comprises a three-dimensional hollow structure. The polygonal metal patch is characterized as having a first area associated therewith (relative to the horizontal plane), and the shield can is characterized as having a second area associated therewith, the second area being less than or equal to a size of the first area.

Generally, the socket antenna module comprises a patch antenna, a ground plane and a shield can. The ground plane has a first side and a second side, and the patch antenna is coupled to the first side and the shield can is coupled to the second side.

In the first embodiment, the ground plane may further comprise a planar rectangular substrate including a perimeter associated therewith, and a plurality of holes wherein each of the plurality of holes are disposed at the perimeter of the planar rectangular substrate.

In some embodiments, the ground plane may further comprise first and second holes each extending through the rectangular substrate, wherein each of the first and second holes is disposed at one of four corners of the rectangular substrate.

In other embodiments the ground plane may further comprise a first hole, a second hole, a third hole, and a fourth hole (the "first through fourth holes"). Each of the first through fourth holes is independently disposed at one of four corners of the rectangular substrate.

In the first embodiment, the shield can may further comprise of a three-dimensional hollow structure.

In the first embodiment, the patch antenna may further comprise of a dielectric substrate, a polygonal metal patch coupled to the dielectric substrate, and a feed connector. The feed connector is coupled to the polygonal metal patch at a first end thereof and further configured to couple with a feed at a second end of the feed connector, the feed connector may span a thickness of the dielectric substrate with the first end and second end disposed on opposite surfaces of the dielectric substrate for coupling the feed to the polygonal metal patch.

In the first embodiment, the polygonal metal patch is further characterized as having a first area associated therewith. The shield can is characterized as having a second area, the second area being less than or equal to a size of the first area.

In some embodiments, the socket antenna module is configured to attach to a transceiver, and wherein the attachment comprises two or more fasteners extending through each of two or more corresponding holes of the ground plane of the socket antenna module.

In a second embodiment, a socket antenna module and transceiver assembly may comprise a transceiver, and a socket antenna module coupled to the transceiver. The transceiver may comprise of a first surface. The socket antenna module may comprise: a patch antenna, a ground plane, and a shield can, the ground plane having a first side and a second side; wherein the patch antenna is coupled to the first side and the shield can is coupled to the second side, and wherein the ground plane comprises a plurality of holes extending therethrough; wherein the transceiver is mechanically attached to the socket antenna module at a plurality of fasteners each extending through one of the plurality of holes of the ground plane, wherein the shield can is capacitively coupled to the transceiver at the first surface thereof; and the patch antenna is electrically coupled to the transceiver via a cable connector.

In the second embodiment, the cable connector may further comprise a first terminus and a second terminus, the first terminus is coupled to the second side of the ground plane; and the second terminus attached to the transceiver.

Alternatively, in the second embodiment, the cable connector may further comprise a first terminus and a second terminus, the first terminus is coupled to the second side of the ground plane; and the second terminus attached to a printed circuit board; said printed circuit board electrically connected to the transceiver.

In the second embodiment, the ground plane may further comprise of a rectangular substrate.

In the second embodiment, the plurality of holes may comprise of first and second holes each extending through the rectangular substrate, wherein each of the first and second holes is disposed at one of four corners of the rectangular substrate.

Alternatively, in the second embodiment the plurality of holes may comprise a first hole, a second hole, a third hole, and a fourth hole; wherein each of the first through fourth holes is independently disposed at one of four corners of the rectangular substrate.

A function of the socket antenna module is to allow for a patch antenna to be coupled with a transceiver without significantly increasing the footprint while also mitigating detuning effects of the antenna. The module is further differentiated by having collinear holes to allow for fast and reliable manufacturability.

Manufacturing

The patch antenna may be obtained commercially, for example and without limitation, the 2JCP2542601a antenna (https://www.2j-antennas.com/antennas/single-internal-antennas/2jcp2542601a-iridium-low-profile-ceramic-patch-thru-hole-mount-antenna/175). Alternatively, the patch antenna may be any that is customized in accordance with the level and knowledge of one having skill in the art.

Generally, the ground plane is made of FR4 with printed circuit design affixed thereto. Otherwise the ground plane can be fabricated in accordance with the level and knowledge of one having skill in the art.

The shield can may be obtained commercially, for example and without limitation the S01-30200500 (https://www.harwin.com/products/S01-30200500/). Alternatively, the shield can may be customized in accordance with the level and knowledge of one having skill in the art.

The transceiver may be obtained commercially, for example and without limitation the Iridium 9602 (https://www.iridium.com/products/iridium-9602/). Alternatively, the transceiver can be customized in accordance with the level and knowledge of one having skill in the art.

Each of the components of the socket antenna module and related system described herein may be manufactured and/or assembled in accordance with the conventional knowledge and level of a person having skill in the art.

Definitions

For purposes herein, the term "patch antenna" means a radio antenna with a low profile which can be mounted on a flat surface.

The term "ground plane" means a flat or nearly flat conducting surface that is part of the antenna.

The term "shield can" means an object that protects a sensitive signal from external electromagnetic signals or preventing a stronger signal from leaking out and interfering with surrounding electronics.

The term "transceiver" means a device that can both transmit and receive communications, in particular a combined radio transmitter and receiver.

The term "printed circuit board" means a circuit board that mechanically supports and electrically connects electrical or electronic components using conductive tracks, pads and other features.

The term "perimeter" means a continuous line or region that forms the boundary of a geometric shape.

The term "area" is used in accordance with its plain and ordinary meaning; i.e. the size of a two-dimensional surface.

First Illustrated Embodiment

Now turning to the drawings, FIG. 1 shows an isometric view of the socket antenna module (100) according to a first illustrated embodiment. The socket antenna module is shown comprising a ground plane (120) with a first side (121) and a second side (122, FIG. 2). A patch antenna (110) is coupled to the first side of the ground plane, and a shield can (130) is coupled to the second side of the ground plane. The ground plane consists of a plurality of holes (125) disposed on a perimeter (124) of the ground plane. The shield can is configured with an area that is less than or equal to an area of the patch (FIG. 2) with respect to the ground plane. FIG. 1 shows the patch antenna in the relative center of the ground plane, but those having knowledge and skill in the art would understand the patch antenna may be placed in alternative locations on the ground plane. The ground plane may be described as, for example and without limitation, a rectangular substrate.

Figure 2:
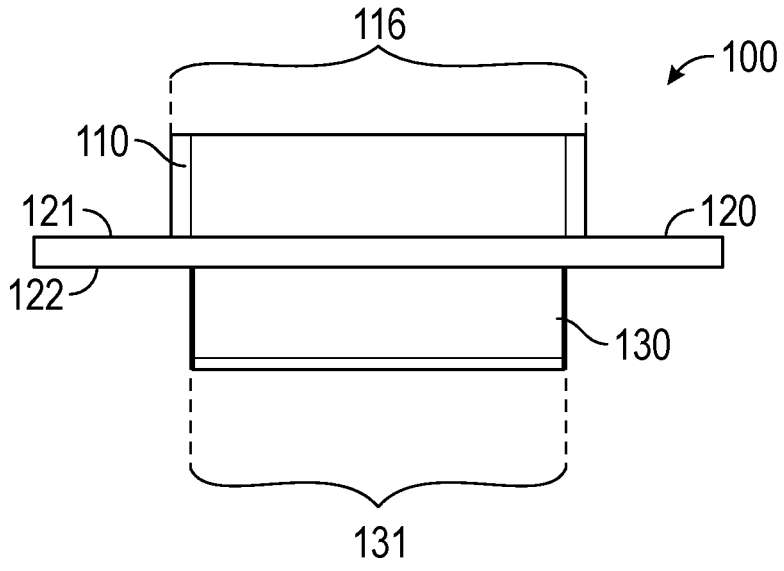
FIG. 2 shows a side view of the socket antenna module in accordance with the first embodiment.

FIG. 2 shows a side view of the socket antenna module (100) in accordance with the first illustrated embodiment. The socket antenna module comprises a patch antenna (110), a ground plane (120), and a shield can (130). The patch antenna is affixed to a ground plane at a first side (121) of the ground plane. The shield can is attached to a second side (122) of the ground plane. The second side of the ground plane is opposite that of the first side. The patch antenna is characterized as having a first area (116), and the shield can is characterized as having a second area (131). Furthermore, the second area is less than or equal to the first area in order to mitigate detuning effects between the patch antenna and a transceiver (140, FIG. 8). The shield can may be further characterized as a three-dimensional hollow structure.

Figure 3:
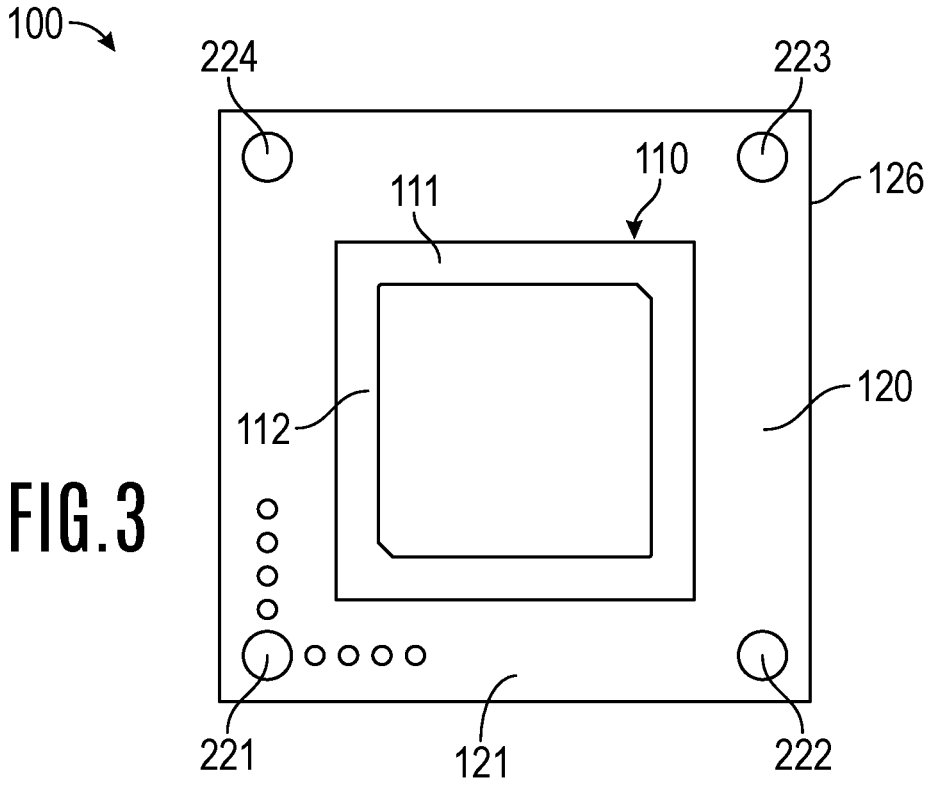
FIG. 3 shows a top view of the socket antenna module in accordance with the first embodiment, the socket antenna module comprising four holes.

FIG. 3 shows a top view of the socket antenna module (100) in accordance with the first illustrated embodiment. Here, the figure shows the patch antenna (110) on the first side (121) of the ground plane (120). The patch antenna is further characterized as having a dielectric substrate (111) and a polygonal metal patch (112) positioned on the dielectric substrate. The ground plane is shown having first hole (221), second hole (222), third hole (223), and fourth hole (224), each independently disposed at one of four corners (126) of the ground plane. The ground plane may be further described as being a planar rectangular substrate.

Figure 4:
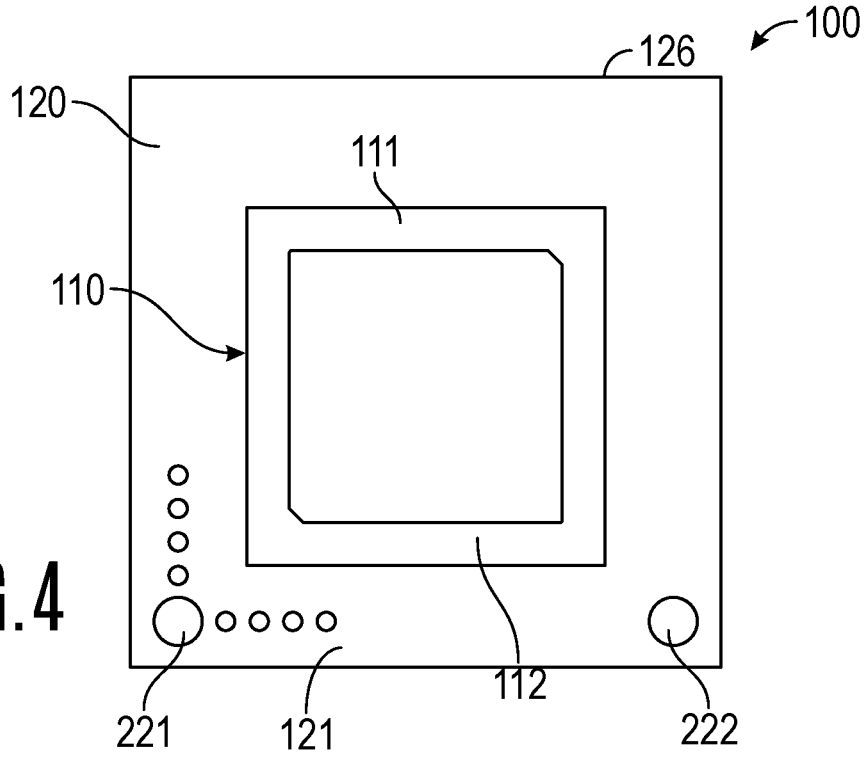
FIG. 4 shows a top view of the socket antenna module in accordance with the first embodiment, the socket antenna module comprising two holes.

FIG. 4 shows a top view of the socket antenna module (100) in accordance with the first illustrated embodiment. Here, the figure shows the patch antenna (110) on the first side (121) of the ground plane (120). The patch antenna is further characterized as having a dielectric substrate (111) and a polygonal metal patch (112) positioned on the dielectric substrate. The ground plane is shown having a first hole (221) and a second hole (222) where the first hole and second hole are each independently disposed at one of four corners (126) of the ground plane. The first hole and second hole are disposed at a common side of the ground plane.

Those having skill in the art will appreciate that the disposition or location of the first hole (221) and second hole (222) may alternatively be at opposite corners (126) of the ground plane (120). Other embodiments may implement alternative configurations of two or more holes for mounting the socket antenna with a transceiver.

Figure 5:
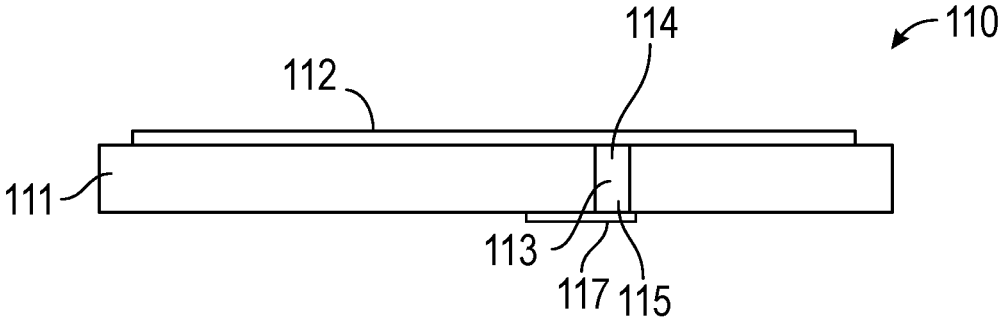
FIG. 5 shows a side section view of the patch antenna according to the first embodiment.

FIG. 5 shows a side section view of a patch antenna (110). The patch antenna comprises a dielectric substrate (111), a polygonal metal patch (112) positioned on the dielectric substrate, and a feed connector (113). The feed connector has a first end (114) and a second end (115). The first end couples with the metal polygonal patch and the second end couples to a feed (117). The feed is configured to electrically connect the patch antenna with a transceiver (140, FIG. 9). The feed connector may extend through the substrate, or around an outer surface of the substrate, with the patch disposed on a first surface and the feed disposed on another surface of the substrate.

Second Illustrated Embodiment

Figure 6:
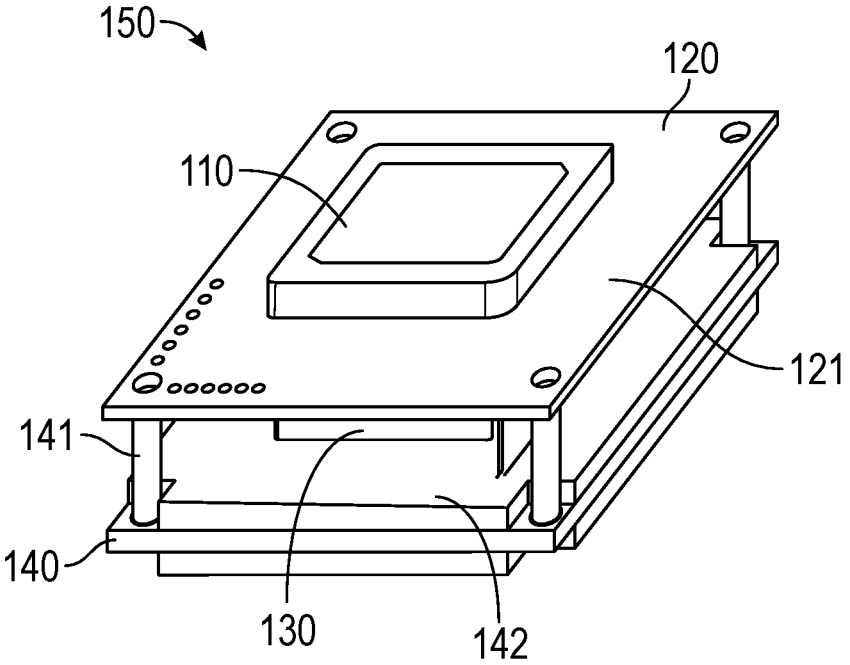
FIG. 6 shows an isometric view of the socket antenna module and transceiver assembly according to a second embodiment, the socket antenna module and transceiver assembly comprising four holes.

FIG. 6 shows an isometric view of a socket antenna module and transceiver assembly (150) according to a second embodiment. The socket antenna module and transceiver assembly comprises a socket antenna module (100, FIG. 1) coupled to a transceiver (140). The socket antenna module comprises a ground plane (120), a patch antenna (110), and a shield can (130). The ground plane has a first side (121) on which the patch antenna is located. The shield can is attached to a second side (122, FIG. 2) of the ground plane, the second side is opposite the first side. The transceiver has a first surface (142) which is coupled to the shield can. The antenna socket module and the transceiver are mechanically coupled by fasteners (141), each of which extends through one of the plurality of holes (125, FIG. 1) and connects to the transceiver. This figure more specifically demonstrates the use of four fasteners corresponding to the first hole (221, FIG. 3.), the second hole (222, FIG. 3), the third hole (223, FIG. 3.), and the fourth hole (224, FIG. 3).

In any of the embodiments herein, hollow spacers may be used to join the socket antenna module and the transceiver such that the fasteners may extend through the hollow spacers to make a secure connection.

Generally, the transceiver (140) may include tapped or threaded holes configured to receive corresponding fasteners, wherein each of the tapped or threaded holes is configured to align with one of the holes of the ground plane (120).

Figure 7:
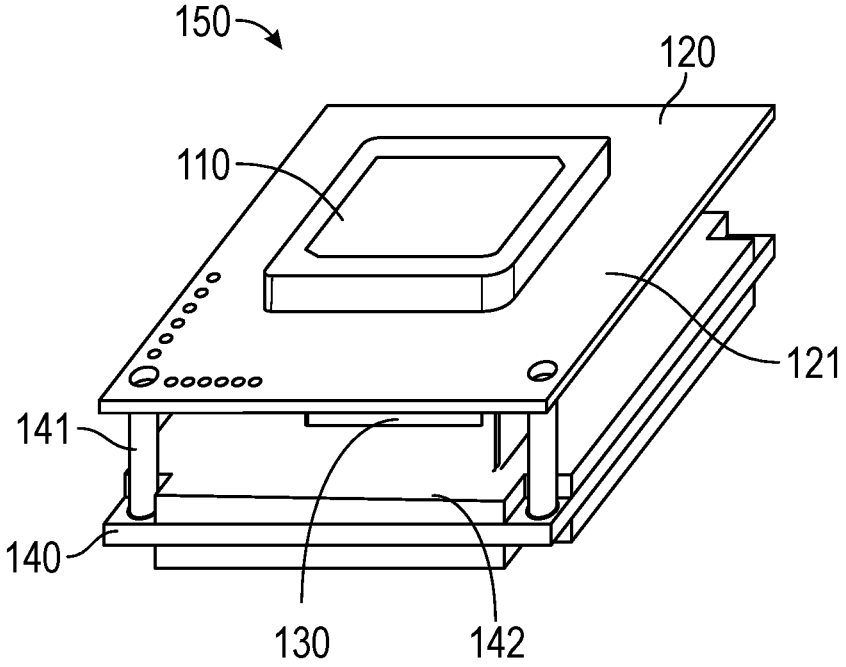
FIG. 7 shows an isometric view of the socket antenna module and transceiver assembly according to the second embodiment, the socket antenna module and transceiver assembly comprising of two holes

FIG. 7 shows an isometric view of a socket antenna module and transceiver assembly (150) in accordance with the second embodiment. The socket antenna module and transceiver assembly comprises a socket antenna module (100, FIG. 1) coupled to a transceiver (140). The socket antenna module comprises ground plane (120), patch antenna (110), and shield can (130). The ground plane has a first side (121) and a second side (122. FIG. 2). The patch antenna is connected to the ground plane at the first side. The shield can is attached to the second side of the ground plane. The transceiver has a first surface (142) which is coupled to the shield can. The antenna socket module and the transceiver are mechanically connected by fasteners (141), which pass through the plurality of holes (125, FIG. 1) and optional hollow spacers and connect to one of a plurality of holes of the transceiver. This figure more specifically demonstrates the use of two fasteners corresponding to the first hole (221, FIG. 4.) and the second hole (222, FIG. 4).

Figure 8:
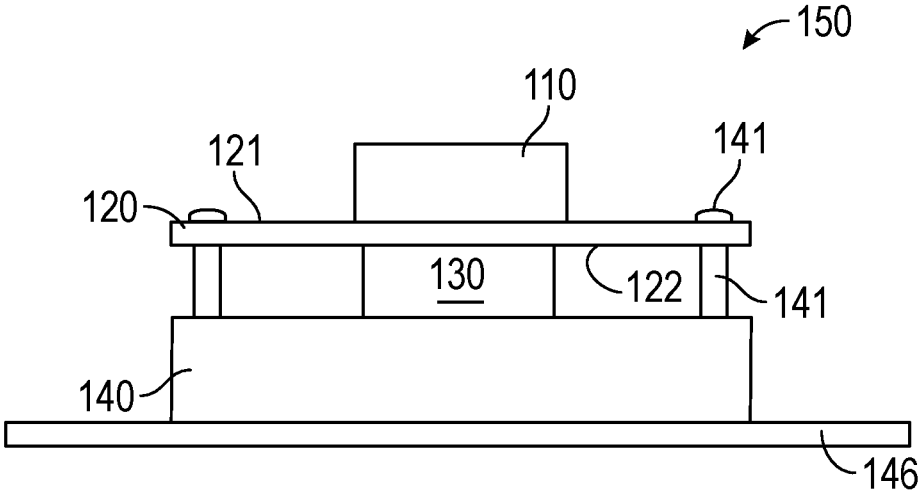
FIG. 8 shows a side view of the socket antenna module and transceiver assembly according to the second embodiment.

FIG. 8 shows a side view of the socket antenna module and transceiver assembly (150) in accordance with the second embodiment. Here, the transceiver (140) is couple to a printed circuit board (146). Those with skill in the art will appreciate that the printed circuit board can be used with other electrical components and electrical connections relating to the transceiver and for other purposes not related to the transceiver. The transceiver is coupled with the shield can (130). The shield can is coupled to a second side (122) of the ground plane (120). The patch antenna (110) is coupled to the first side (121) of the ground plane. Fasteners (141) are shown coupling the ground plane to the transceiver.

Figure 9:
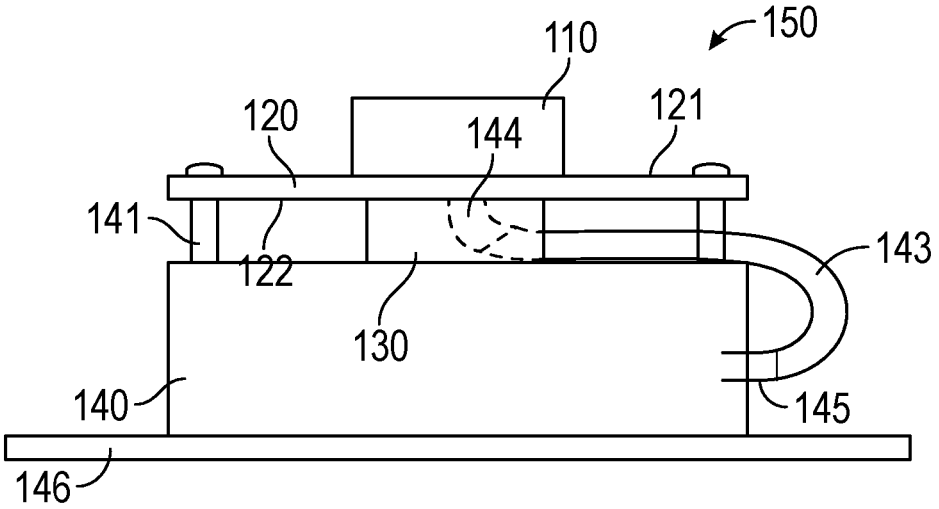
FIG. 9 shows a side view of the socket antenna module and transceiver assembly according to the second embodiment, the socket antenna module and transceiver assembly coupled by a cable connector.

FIG. 9 shows a side view of the socket antenna module and transceiver assembly (150) in accordance with the second embodiment. The socket antenna module and transceiver comprises patch antenna (110), ground plane (120), shield can (130), and transceiver (140). The patch antenna is coupled to a first side (121) of the ground plane. The shield can is couple to a second side (122) of the ground plane opposite the first side. The transceiver is located adjacent to the available side of the shield can. A printed circuit board (146) is affixed to the transceiver. The entire assembly is held together with fasteners (141) which utilize the holes of the ground plane and transceiver. The patch antenna and the transceiver are electrically connected with a cable connector (143). The cable connector has a first terminus (144) and a second terminus (145), the first terminus is coupled to the patch antenna feed, which is generally at the second side of the ground plane. The second terminus is coupled to the transceiver.

The cable connector (143, FIG. 9) may extend out of the shield can (130, FIG. 9).

Alternatively, the cable connector (143, FIG. 9) may extend from the dielectric substrate (111, FIG. 5) of the patch antenna (110, FIG. 5) where it is coupled to the feed.

Figure 10:
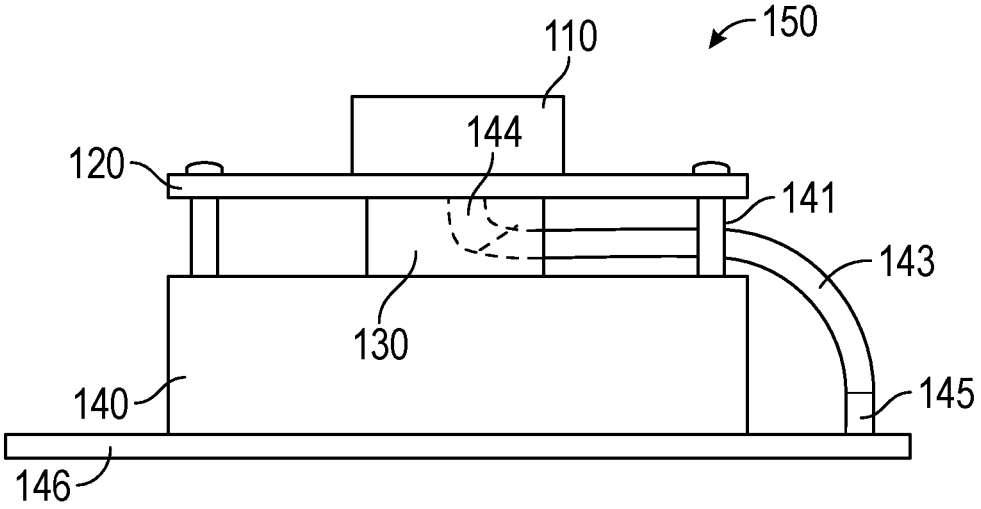
FIG. 10 shows a side view of the socket antenna module and transceiver assembly according to the second embodiment, the socket antenna module and transceiver assembly coupled by a cable connector through a printed circuit board.

FIG. 10 shows a side view of the socket antenna module and transceiver assembly (150) in accordance with the second embodiment. The socket antenna module and transceiver comprise of a patch antenna (110), a ground plane (120), a shield can (130), and a transceiver (140). The patch antenna is coupled to a first side (121) of the ground plane. The shield can is coupled to a second side (122) of the ground plane opposite the first side. The transceiver is coupled to the shield can opposite the ground plane. A printed circuit board (146) is coupled to the transceiver. The assembly is mechanically coupled with fasteners (141) which pass through the holes of the ground plane and transceiver, thereby joining the socket antenna module and transceiver to form an assembly. The patch antenna and the transceiver are electrically connected with a cable connector (143). The cable connector has a first terminus (144) and a second terminus (145). The first terminus is coupled to the feed, which is generally disposed at the second side of the ground plane. The second terminus is coupled to the printed circuit board. The printed circuit board is electrically coupled to the transceiver.

FEATURE LIST socket antenna module (100)
patch antenna (110)
ground plane (120)
shield can (130)
socket antenna module and transceiver assembly (150)
first side (121)
second side (122)
perimeter (124)
plurality of holes (125)
corners (126)
first hole (221)
second hole (222)
third hole (223)
fourth hole (224)
dielectric substrate (111)
polygonal metal patch (112)
feed connector (113)
first end (114)
second end (115)
first area (116)
feed (117)
second area (131)
transceiver (140)
fastener (141)
first surface (142)
cable connector (143)
first terminus (144)
second terminus (145)
printed circuit board (146)

What is claimed is:

1. A socket antenna module (100), comprising:

a ground plane (120) configured to extend within a horizontal plane (127) and having a first side (121), a second side (122) opposite the first side, and a perimeter (124) associated therewith, wherein the ground plane further comprises a plurality of holes (125), each of said holes being disposed along the perimeter of the ground plane at one of a plurality of corners (126) thereof;

a patch antenna (110) coupled to the ground plane at the first side, the patch antenna including a dielectric substrate (111), a polygonal metal patch (112) coupled to the dielectric substrate, a feed connector (113) coupled to the polygonal metal patch at a first end (114) thereof and further configured to couple with a feed at a second end (115) thereof; and a shield can (130) coupled to the ground plane at the second side, the shield can comprising a three-dimensional hollow structure (132);

wherein the patch antenna is characterized as having a first area (116) associated therewith; and wherein the shield can is characterized as having a second area (131) associated therewith, the second area being less than or equal to a size of the first area.

2. A socket antenna module, comprising:

a patch antenna;

a ground plane; and a shield can;

the ground plane having a first side and a second side;

wherein the patch antenna is coupled to the first side and the shield can is coupled to the second side, the patch antenna is characterized as having a first area and the shield can is characterized as having a second area such that the second area is less than or equal to the first area.

3. The socket antenna module of claim 2, the ground plane further comprising:

a planar rectangular substrate including a perimeter associated therewith; and a plurality of holes wherein each of the plurality of holes are disposed at the perimeter of the planar rectangular substrate.

4. The socket antenna module of claim 2, the ground plane further comprising:

a planar rectangular substrate (123); and first (221) and second holes (222) each extending through the planar rectangular substrate, wherein each of the first and second holes is disposed at one of four corners of the planar rectangular substrate.

5. The socket antenna module of claim 2, the ground plane further comprising:

a rectangular substrate;

a first hole, a second hole, a third hole (223), and a fourth hole (224);

wherein each of the first through fourth holes is independently disposed at one of four corners of the rectangular substrate.

6. The socket antenna module of claim 2, the shield can further comprising a three-dimensional hollow structure.

7. The socket antenna module of claim 2, the patch antenna further comprising:

a dielectric substrate;

a polygonal metal patch coupled to the dielectric substrate; and a feed connector coupled to the polygonal metal patch at a first end thereof and further configured to couple with a feed at a second end of the feed connector.

8. The socket antenna module of claim 2, wherein the socket antenna module is configured to attach to a transceiver (140), and wherein an attachment comprises two or more fasteners (141) extending through each of two or more corresponding holes of the ground plane of the socket antenna module.

9. A socket antenna module and transceiver assembly, comprising:

a transceiver, and a socket antenna module coupled to the transceiver;

the transceiver comprising:

a first surface (142);

the socket antenna module comprising:

a patch antenna, a ground plane, and a shield can, the ground plane having a first side and a second side; wherein the patch antenna is coupled to the first side and the shield can is coupled to the second side, wherein the ground plane comprises a plurality of holes extending therethrough, and wherein the patch antenna is characterized as having a first area and the shield can is characterized as having a second area such that the second area is less than or equal to the first area;

wherein:

the transceiver is mechanically attached to the socket antenna module at a plurality of fasteners each extending through one of the plurality of holes of the ground plane;

the shield can is capacitively coupled to the transceiver at the first surface thereof; and the patch antenna is electrically coupled to the transceiver via a cable connector (143).

10. The socket antenna module and transceiver assembly of claim 9, the cable connector further comprising:

a first terminus (144) and a second terminus (145);

the first terminus coupled to the second side of the ground plane; and the second terminus attached to the transceiver.

11. The socket antenna module and transceiver assembly of claim 9, the cable connector further comprising:

a first terminus and a second terminus;

the first terminus coupled to the second side of the ground plane; and the second terminus attached to a printed circuit board (146);

said printed circuit board electrically connected to the transceiver.

12. The socket antenna module and transceiver assembly of claim 9, the ground plane further comprising a rectangular substrate.

13. The socket antenna module and transceiver assembly of claim 12, wherein the plurality of holes comprises first and second holes each extending through the rectangular substrate, wherein each of the first and second holes is disposed at one of four corners of the rectangular substrate.

14. The socket antenna module and transceiver assembly of claim 12, where the plurality of holes comprises:

a first hole, a second hole, a third hole, and a fourth hole;

wherein each of the first through fourth holes is independently disposed at one of four corners of the rectangular substrate.

15. The socket antenna module of claim 1, further comprising a cable connector electrically coupled to the feed, wherein the cable connector extends through an opening of the shield can.

16. The socket antenna module of claim 2, further comprising a cable connector electrically coupled to the patch antenna, wherein the cable connector extends through an opening of the shield can.

17. The socket antenna module and transceiver assembly of claim 9, wherein the cable connector extends through an opening of the shield can.

18. The socket antenna module and transceiver assembly of claim 9, wherein the transceiver is disposed externally from the shield can.

19. The socket antenna module and transceiver assembly of claim 9, wherein the transceiver comprises an area greater than the second area of the shield can.

20. The socket antenna module and transceiver assembly of claim 9, wherein each of the plurality of fasteners is disposed externally from the shield can.

* * * * *